US005356365A

United States Patent [19]

Brierton

[11] Patent Number: 5,356,365

[45] Date of Patent: Oct. 18, 1994

[54] TEMPERATURE CONTROLLED CENTRIFUGE

[75] Inventor: Mark J. Brierton, Littleton, Colo.

[73] Assignee: Cobe Laboratories, Inc., Lakewood, Colo.

[21] Appl. No.: 201,717

[22] Filed: Feb. 25, 1994

Related U.S. Application Data

[63] Continuation of Ser. No. 868,989, Apr. 15, 1992.

[51] Int. Cl.[5] ..... B04B 15/02; B04B 11/04

[52] U.S. Cl. ..... 494/14; 494/29; 494/45; 494/50

[58] Field of Search ..... 165/80.4, 86, 168; 422/72, 101; 494/13, 14, 23, 27, 29, 42, 45, 50

[56] References Cited

U.S. PATENT DOCUMENTS

| | | | |
|---|---|---|---|
| 3,727,832 | 4/1973 | Maclin | 494/13 |
| 3,737,096 | 6/1973 | Jones et al. | 233/19 |
| 3,766,845 | 10/1973 | Amstad | 494/14 |
| 3,826,435 | 7/1974 | Pujol | 494/14 |
| 3,856,470 | 12/1974 | Cullis et al. | 23/253 |
| 3,916,152 | 10/1975 | Hinman | 219/389 |
| 3,981,437 | 9/1976 | Hemfort et al. | 233/11 |
| 4,131,369 | 12/1978 | Gordon | 494/13 |
| 4,135,883 | 1/1979 | McNeil et al. | 422/72 |
| 4,193,536 | 3/1980 | Kubota | 494/14 |
| 4,256,696 | 3/1981 | Soodak | 422/72 |
| 4,690,669 | 9/1987 | Williams | 494/14 |
| 4,982,514 | 1/1991 | Ullum | 165/86 |

FOREIGN PATENT DOCUMENTS

| | | | |
|---|---|---|---|
| 0344444 | 12/1989 | European Pat. Off. . | |
| 1123727 | 11/1984 | U.S.S.R. | 494/14 |

*Primary Examiner*—David A. Scherbel
*Assistant Examiner*—Terrence R. Till
*Attorney, Agent, or Firm*—Sheridan Ross & McIntosh

[57] ABSTRACT

A temperature-controlled centrifuge in which a heat exchanger is attached to the bottom portion of the centrifuge bowl to remove heat from the bowl and materials within the bowl interacting therewith. In one embodiment, a heat exchange plate having a plurality of substantially annular channels is appropriately attached to the bottom of the centrifuge bowl and has a surface which is thus substantially coextensive therewith. Each of these channels are positioned at different radial distances from the central axis of the heat exchange plate and each extends substantially about such axis. An appropriate heat transfer medium may thus be circulated through each of these channels to thereby substantially control a temperature across the entire bottom of the bowl. The heat transfer medium may be provided to each of the channels by a common feed inlet which also allows for the use of flow regulators where appropriate, and the heat transfer medium may also thus be removed from the channels by a common dump line. Consequently, coaxial conduits may interact with the bottom portion of the heat exchanger for interconnection with the common feed and dump lines.

19 Claims, 4 Drawing Sheets

TEMPERATURE CONTROLLED CENTRIFUGE

RELATED APPLICATIONS

This application is a continuation of co-pending U.S. patent application Ser. No. 07/868,989, filed Apr. 15, 1992, and entitled "TEMPERATURE CONTROLLED CENTRIFUGE".

FIELD OF THE INVENTION

The present invention generally relates to the field of centrifuges and, more particularly, to controlling the temperature of a centrifuge and materials contained therein during operation.

BACKGROUND OF THE INVENTION

In centrifuging apparatus, constituents/components of a given material (e.g., liquid solutions/mixtures) can be separated based upon the variation of their respective densities and the centrifugal forces to which such constituents/components are subjected. Generally, the material is positioned within a centrifuge bowl which is rotated at a speed such that the various constituents will effectively assume a radial position within the bowl based upon their respective densities (i.e., constituents having higher densities will be closer to the rim of the centrifuge bowl than those having lower densities).

During rotation of the centrifuge bowl, which is often at relatively high angular velocities in order to generate the magnitude of centrifugal forces needed for separation, the temperature of the bowl and the materials contained therein may undesirably change. For instance, certain materials and/or constituents may experience undesired degradation at ambient temperature. Moreover, certain temperatures may have an undesirable/adverse effect on certain reactions/processes which take place during centrifuging, or may actually cause an undesirable reaction amongst certain of the constituents. In addition, certain temperatures may impede the separation of certain constituents from the remainder of the material by centrifuging.

Based upon the foregoing, a number of alternatives have been explored for establishing and/or maintaining a temperature of a centrifuge and thus the material within the centrifuge bowl. For instance, it is known to enclose the entire centrifuge within a temperature-controlled housing. More particularly, the air within the housing is maintained at the desired temperature so as to maintain the centrifuged material at such temperature by convection. In these types of configurations, given the heat transfer inefficiencies of convection utilizing air as the heat transfer medium, it is important to maintain an air-tight seal for the housing in order to maintain temperature control. Consequently, any opening of the housing to remove and/or add materials to the centrifuge will thus affect the housing temperature, and upon any subsequent closing of the housing a certain period of time will be required before the desired steady-state temperature is once again reached.

In contrast to attempting to maintain the temperature of the entire centrifuge by utilizing the above-described types of temperature-controlled housings, other apparatus have attempted to directly cool or heat only the periphery of the centrifuge bowl. For instance, U.S. Pat. No. 3,981,437 to Hemfort et al., issued Sep. 21, 1976, discloses positioning an insert having a plurality of circumferentially spaced ribs against the outer wall or drum of the centrifuge. The ribs form a plurality of passageways between the insert and the drum such that coolant may be injected in and flow through the passageways. The coolant flows through the passageways and is discharged through a plurality of radial ports in the drum for engagement with a stationary casing which is spaced from the rotating drum and which incorporates a cooling jacket to reduce the temperature of the coolant prior to its recirculation to the periphery of the drum.

Temperature control systems have also been incorporated on other types of rotating apparatus. For instance, certain analyzers are available in which a plurality of cuvettes are positioned on an outer portion of a rotor. These cuvettes typically have a relatively small volume for receiving at least two different constituents which are initially maintained in separate but interconnected cavities in the rotor. As a result of the centrifugal forces created by rotation of the rotor at a certain speed, the constituents from the separate cavities enter a radially aligned cuvette. The reaction of the two constituents in each cuvette is then monitored and/or analyzed. Since the reaction of the constituents is often temperature-sensitive, heating devices are often employed so as to maintain the peripherally-positioned cuvettes and their constituents at a certain temperature.

Various temperature control alternatives have been explored for cuvette rotors which are generally of the above-described type. For instance, hot air has been used to control either the temperature of an entire housing in which the cuvette rotor is positioned, or at least the space between the periphery of the rotor, which again contains the cuvettes, and the rotor housing. U.S. Pat. Nos. 3,916,152 to Hinman, issued Oct. 28, 1975, and 4,135,883 to McNeil et al., issued Jan. 23, 1979, are generally representative of these efforts. Other apparatus have incorporated heating elements directly on the periphery of the rotor substantially adjacent to the cuvettes to provide for a conductive heat transfer as representatively disclosed in U.S. Pat. Nos. 3,856,470 to Cullis et al., issued Dec. 24, 1974 and 4,256,696 to Soodak, issued Mar. 17, 1981.

Notwithstanding the foregoing, there remains a need for a temperature control system which may be readily adapted for use with centrifuges of a variety of configurations, and which effectively regulates the temperature of substantially the entire centrifuge bowl and materials contained therein without significantly impacting the structure of an existing centrifuge and/or without requiring extensive modifications/additions to the centrifuge and its surroundings.

SUMMARY OF THE INVENTION

The present invention is a temperature controlled centrifuge for regulating the temperature across the base portion of the centrifuge bowl, and thus substantially the entire spectrum of materials contained within the centrifuge. In one aspect of the present invention, a heat exchanger is attached to the base and thus rotates with the centrifuge bowl. Preferably, the heat exchanger has a profile which substantially matches that of the base portion, and is thus effectively coextensive therewith to enhance the heat transfer from the base to the heat exchanger. Consequently, a heat transfer medium having a desirable convective heat transfer coefficient may be circulated through the heat exchanger to change the temperature of the base. As can be appreciated, a heat exchanger of this type may be readily adapted for use with a variety of configurations of centrifuges and only requires limited structural modification of the centrifuge to accommodate the attachment of the heat exchanger to the centrifuge bowl.

In another aspect of the present invention, a heat exchanger of the above-described type comprises at least two separate channels for receiving and directing the heat transfer medium. In order to enhance the heat transfer efficiency, an upper surface of these channels may actually be defined by a surface of the base portion such that the heat transfer medium is directly applied thereto. These channels may also be substantially annular and concentrically positioned about the rotational axis of the centrifuge bowl, but at different radial distances therefrom. This configuration provides a number of advantages, including maintaining the rotational balance of the centrifuge and providing for an effective distribution of the heat transfer medium. Further in this regard, a common, radially extending feed line may provide the heat transfer medium to each of the channels. As a result, flow regulators may be incorporated to control the volume of heat transfer medium into the individual channels where necessary to further accommodate for the effective distribution of the heat transfer medium.

In another aspect of the present invention, a heat exchanger is attached to the base and a heat transfer medium is circulated therethrough. Preferably, a surface of the heat exchanger is substantially coextensive with the base and a heat transfer medium having a desirable convective heat transfer coefficient is utilized to enhance the overall heat transfer characteristics. With further regard to the heat transfer medium, it is introduced to and removed from the rotating heat exchanger through conduits which are substantially concentrically positioned about the rotational axis of the centrifuge bowl. As can be appreciated, this configuration reduces the amount of space required in direct proximity to the centrifuge and does not have any significant effect on the access to the centrifuge during operations. In fact, this particular coaxial configuration about the rotational axis of the centrifuge bowl may be readily incorporated into the drive assembly commonly used to rotate the centrifuge.

One embodiment which incorporates all aspects of the present invention generally includes a centrifuge bowl having a base which extends radially outward from the rotational axis of the bowl to an outer wall or rim. A heat exchange plate is attached to the bottom, exterior portion of the base and is substantially coextensive therewith to enhance the heat transfer from the base and to reduce the space required for adapting the present invention to an existing centrifuge. The heat exchange plate includes a plurality of substantially annular channels which are substantially concentrically positioned about the rotational axis of the centrifuge bowl, but at different radial distances therefrom. Consequently, the rotational balance of the centrifuge is substantially maintained, even while a heat transfer medium is being circulated therethrough. In order to enhance heat transfer efficiency, an upper surface of these channels may actually be defined by the bottom of the base, although the channels may of course be a closed system within the heat exchange plate (i.e., in the closed system the heat transfer medium is completely retained within the heat exchange plate and does not directly engage the base).

The identified plurality of channels accommodate for an effective distribution of an appropriate heat transfer medium (e.g., one having a desirable convective heat transfer coefficient) throughout the heat exchange plate. In order to further enhance this distribution, a common, radially extending feed line may provide the heat transfer medium to each of the channels. As a result, appropriate flow regulators or orifices may then be incorporated to control the flow of heat transfer medium into the respective channels in a desired manner. Therefore, the heat transfer medium may flow through each of the channels at a desired rate and then enter into a common, preferably radially extending, dump line for removal of the heat transfer medium from the heat exchange plate for cooling or heating, and recirculation.

In order to provide the heat transfer medium to and remove the heat transfer medium from the heat exchange plate in the described manner, this embodiment of the present invention utilizes two coaxial conduits which engage the central portion of the heat exchange plate substantially about the rotational axis of the centrifuge bowl. These coaxial conduits thereby further allow for the maintenance of the rotational balance of the centrifuge and for the present invention to be readily incorporated into the drive assembly for the centrifuge, thereby not significantly affecting the space requirements of the centrifuge. The heat transfer medium is thus pumped through one of the conduits, preferably the innermost, under pressure and is provided to each of the channels through the common feed line. Based upon the channel configurations and/or the flow regulators utilized therewith, the desired flow of heat transfer medium through each of the channels is thereby achieved. The heat transfer medium from the plurality of channels thus flows into the common dump line which directs the heat transfer medium back toward the center of the heat exchange plate where it exits therefrom through the other of the conduits, preferably the outermost, for appropriate cooling or heating, and recirculation to the heat exchange plate.

DETAILED DESCRIPTION

The present invention will be described with reference to the attached drawings which assist in illustrating the pertinent features thereof. Generally, the present invention is a temperature controlled centrifuge in which the temperature of the base portion of the centrifuge bowl, and thus the materials which contact, directly or indirectly, the base portion is controlled by a heat exchanger which is attached to the bottom, exterior portion of the base and thus rotates therewith. Although the rotatable heat exchanger may be incorporated upon a variety of types and configurations of centrifuges, the present invention will be described with regard to a variable volume centrifuge, the operating principles of which are generally referred to herein. U.S. Pat. No. 3,737,096 to Jones et al., which has been assigned to the assignee of this patent application, describes one type of a variable volume centrifuge in more detail, the disclosure of which is incorporated by reference herein.

Figure 1:
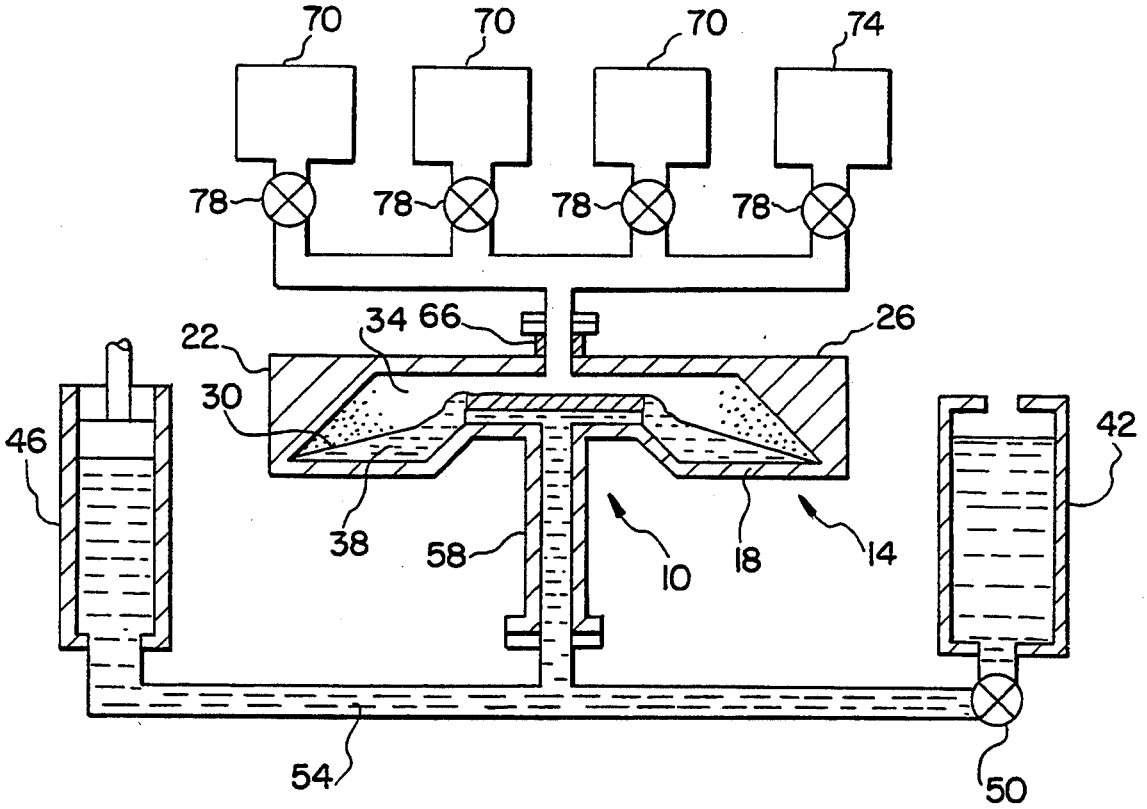
FIG. 1 is a schematic, cross-sectional view of a variable volume centrifuge.

The general operational principles of a variable volume centrifuge are illustrated in FIG. 1. The centrifuge 10 includes a centrifuge bowl 14 which is effectively an upwardly opening container having a base 18 and a rim 22. The centrifuge bowl 14 receives both the particular material to be centrifuged, including any additives introduced therein, and the fluid 54 which varies the volume of the centrifuge bowl 14. In this regard, the centrifuge bowl 14 is separated into upper and lower chambers 34, 38 by a substantially flexible membrane 30 which is appropriately attached to the base 18 at both its outer and inner, central portions.

The lower chamber 38 of the centrifuge bowl 14 is fluidly connected via the interior of a rotatable centrifuge shaft 58 to an appropriate fluid source, such as a hydraulic fluid reservoir 42, pump 46, and valve 50. Consequently, fluid 54 may be introduced into and removed from the lower chamber 38 to raise and lower the membrane 30, and thus vary the volume of the upper chamber 34 of the bowl 14. The upper chamber 34 of the centrifuge bowl 14 typically receives a substantially flexible container (not shown) for containing the material to be centrifuged. In order to allow for the introduction into and/or removal of various substances (e.g., additives) from the flexible container during centrifuging, the flexible container is interconnected with an adapter 66 which extends above a cover 26 of the centrifuge bowl 14, the cover being appropriately attached to the rim 22. The adapter 66 is thus connectable to various fluid sources 70 or collectors 74 which are isolatable from the upper chamber 34 by valves 78.

In preparation for centrifuging, the flexible container is positioned and secured in the centrifuge bowl 14 in a known manner and the cover 26 is positioned over and secured to the centrifuge bowl 14. The material to be centrifuged is provided to the flexible container after being positioned in the centrifuge bowl 14 since the flexible container is interconnected with the adapter 66, which again extends above the cover 26 for interconnection with one or more fluid sources 70 and/or collectors 74. When the material is in the flexible container, the centrifuge 10 is rotated by an appropriate source (not shown) which directs the heavier density constituents of the material toward the rim 22 of the centrifuge bowl 14, while those lighter density constituents remain closer to the central portion of the base 18. At an appropriate time during centrifuging, fluid may be introduced into the lower chamber 38 through the centrifuge shaft 58 to, for instance, remove the lighter density constituents of the material from the centrifuge bowl 14. More particularly, the valve 50 being closed, the pump 46 may be activated such that hydraulic fluid 54 is provided to the lower chamber 38 to raise the flexible membrane 30 and thereby force the lighter density constituents out of the centrifuge bowl 14 through the adapter 66. As can be appreciated, the hydraulic fluid will also be forced outwardly by centrifugal force when in the lower chamber 38. After the desired constituents have been removed from the centrifuge bowl 14, either other materials and/or other additives may have been processed or not. In the first case, these materials may be provided by means of an external pump (not shown) to the centrifuge bowl 14, the centrifuge going on spinning. The valve 50 being opened, the materials provided to the bowl 14 force, through the membrane 30, the hydraulic fluid from the lower chamber 38 to the reservoir 42. In the other case, the centrifuge is stopped and, the valve 50 being opened, the hydraulic fluid 54 flows from the lower chamber 38 to the reservoir 42, and the membrane 30 lowers by gravity.

Figure 2:
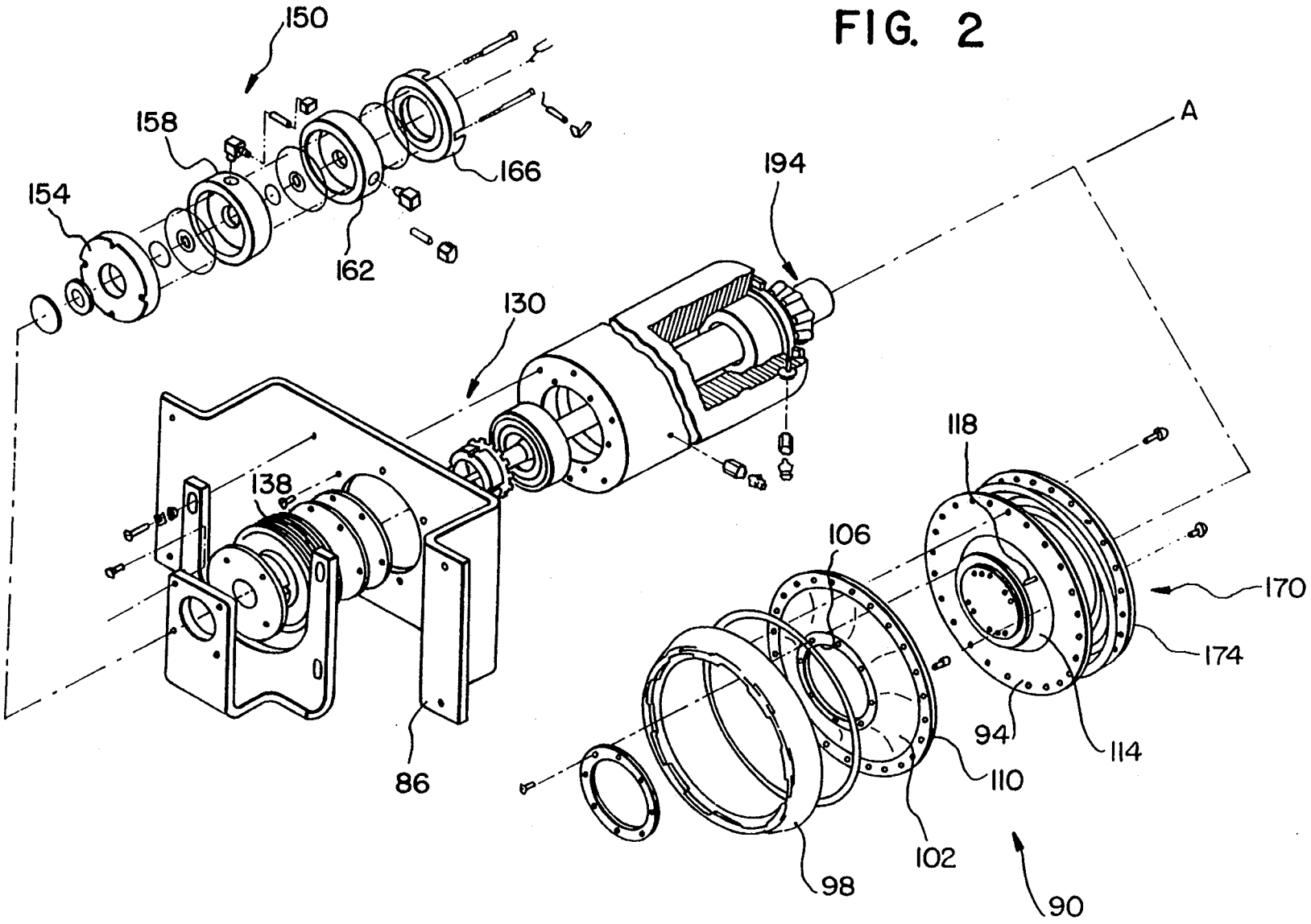
FIG. 2 is an exploded, perspective view of one embodiment of the temperature controlled centrifuge of the present invention.

One embodiment of temperature controlled centrifuge which incorporates all aspects of the present invention is illustrated in FIG. 2. This centrifuge is a variable volume configuration similar to the centrifuge 10 discussed above and may be attached to an appropriate support (not shown) by a mounting 86. Consequently, the centrifuge includes a centrifuge bowl 90, a drive assembly 130 for rotating the centrifuge bowl 90, a volume variation assembly (not shown) for changing the volume of the centrifuge bowl 90, and a seal assembly 150 to account for the drive assembly 130 and volume variation assembly sharing certain components, namely the shaft assembly 194. However, in order to provide for the desired temperature control function of certain portions of the centrifuge bowl 90, the centrifuge also includes a temperature control assembly 170.

The centrifuge bowl 90 includes a base 94 and a centrifuge rim 98 which effectively define an upwardly opening container for the materials to be centrifuged. The volume of the centrifuge bowl 90 is variable and thus the bowl 90 incorporates a substantially flexible diaphragm 102. An inner mounting ring 106 of the diaphragm 102 is appropriately secured to a raised mounting surface 114 in the central portion of the base 94, while an outer mounting ring 110 of the diaphragm 102 is appropriately secured to the outer portion of the base 94. The interior portion of the base 94 and the flexible diaphragm 102 thus define a lower chamber for receiving fluid through ports or slots 118 on the side portion of the mounting surface 114 to vary the volume of the centrifuge bowl 90 in the above-described manner. The diaphragm 102 and a cover (not shown), which may be attached to the rim 98 as in the case of the centrifuge 10 discussed above, define an upper chamber of the centrifuge bowl 90 for receiving the material, which is again typically contained within a substantially flexible container (not shown).

The centrifuge bowl 90 is appropriately interconnected with the drive assembly 130 such that the bowl 90 may be rotated to apply the necessary centrifugal force to the materials positioned in the upper chamber of the bowl 90. In this regard, the drive assembly 130 generally includes a shaft assembly 194, which is attached to the bottom of the base 94 about a rotational axis A of the bowl 90, and a pulley 138 which interconnects the shaft assembly 194 with a motor (not shown) to impart rotational motion to the shaft assembly 194. A seal assembly 150 is also interconnected with the rotating shaft assembly 194 such that hydraulic fluid may be provided to and removed from the lower chamber of the centrifuge bowl 90 by the volume variation assembly, through the shaft assembly 194, to vary the volume of the upper chamber of the bowl 90 in the manner discussed above with regard to centrifuge 10 (i.e., the seal assembly 150 accommodates for rotation of the shaft assembly 194 or at least portions thereof such that the shaft assembly 194 can provide its rotational driving function and its fluid provision function). Based upon the foregoing, it can be appreciated that the centrifuge represented in FIG. 2 performs the centrifuging function similarly to the centrifuge 10 discussed above.

During rotation of the centrifuge bowl 90, there is a tendency for the temperature of both the materials within the bowl 90 (e.g., materials in the upper chamber and any fluid in the lower chamber for varying the volume of the upper chamber) and the bowl 90 itself, if such temperature is different from the ambient one, to move towards the ambient temperature. This change in temperature may have an undesirable or even adverse effect on the material being centrifuged and/or certain constituents thereof and including any additives, on certain reactions/processes which take place during centrifuging, and/or on the centrifuging process itself. A general principle of centrifuging is that constituents/-components of a given material/mixture can be separated based upon the variation of their respective densities and the centrifugal forces to which such constituents/components are exposed. In some cases, the desired constituent/component which is to be separated may have a density which would result in the constituent being positioned inwardly of the rim 98 during centrifuging. Consequently, the above-identified potential concerns with regard to the change in temperature could apply throughout substantially the entire spectrum of the material, and thus across substantially the entire base 94 (e.g., a desired constituent positioned inwardly of the rim 98 to be separated and removed from the upper chamber of the bowl 90 may be subjected to the effects of the above-described change in temperature).

Figure 3:
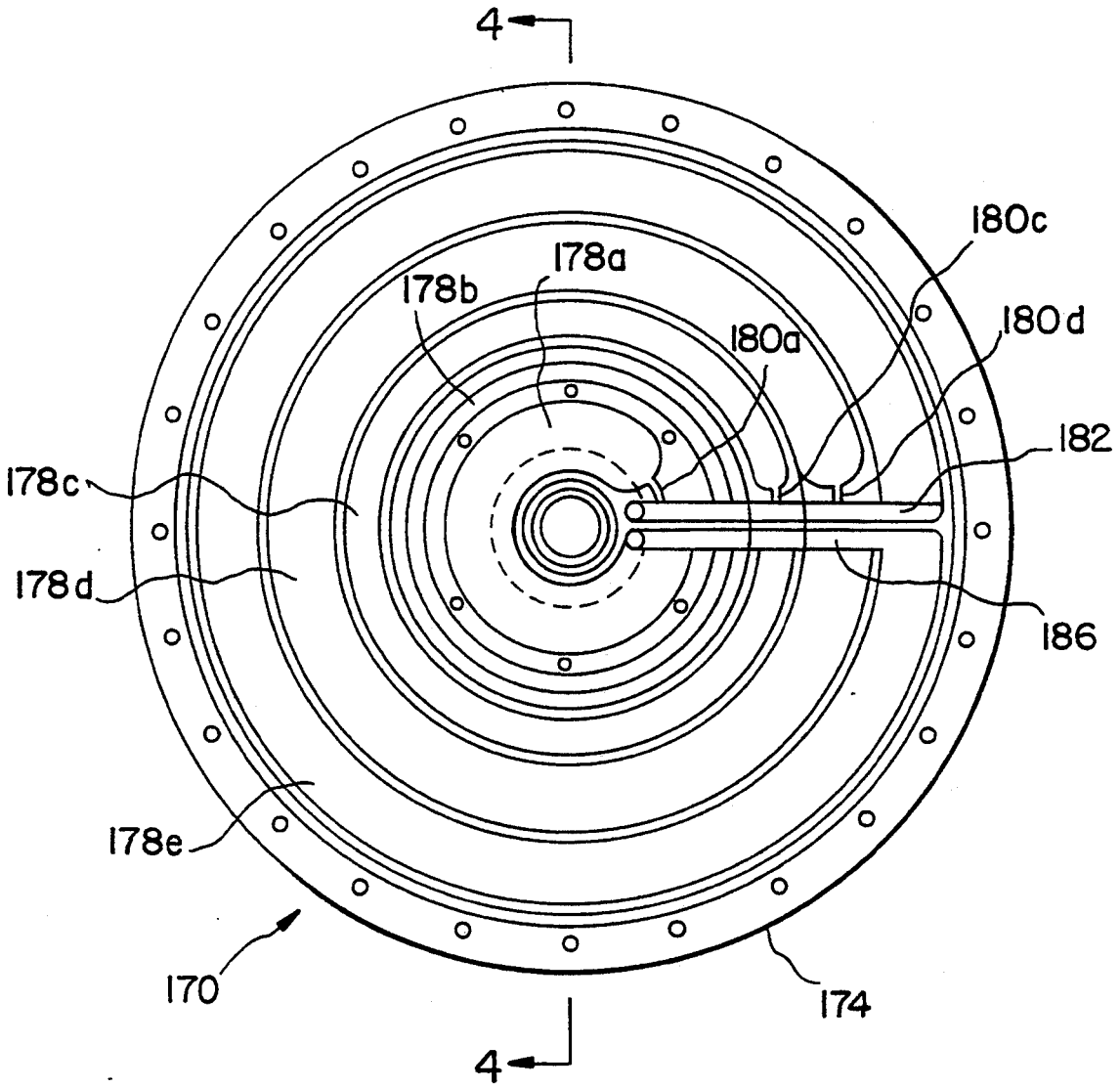
FIG. 3 is a top view of a heat exchange plate.
Figure 4:
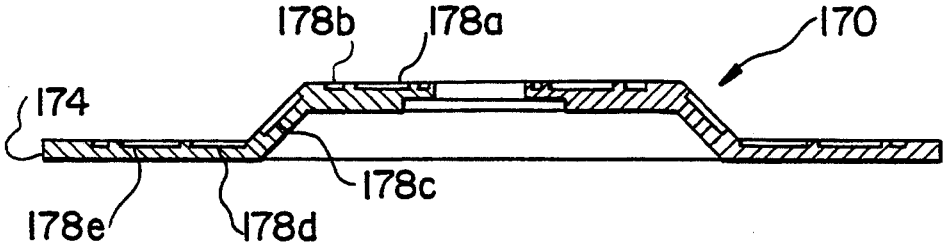
FIG. 4 is a cross-sectional view of the heat exchange plate of FIG. 3 taken along line 4—4.
Figure 5:
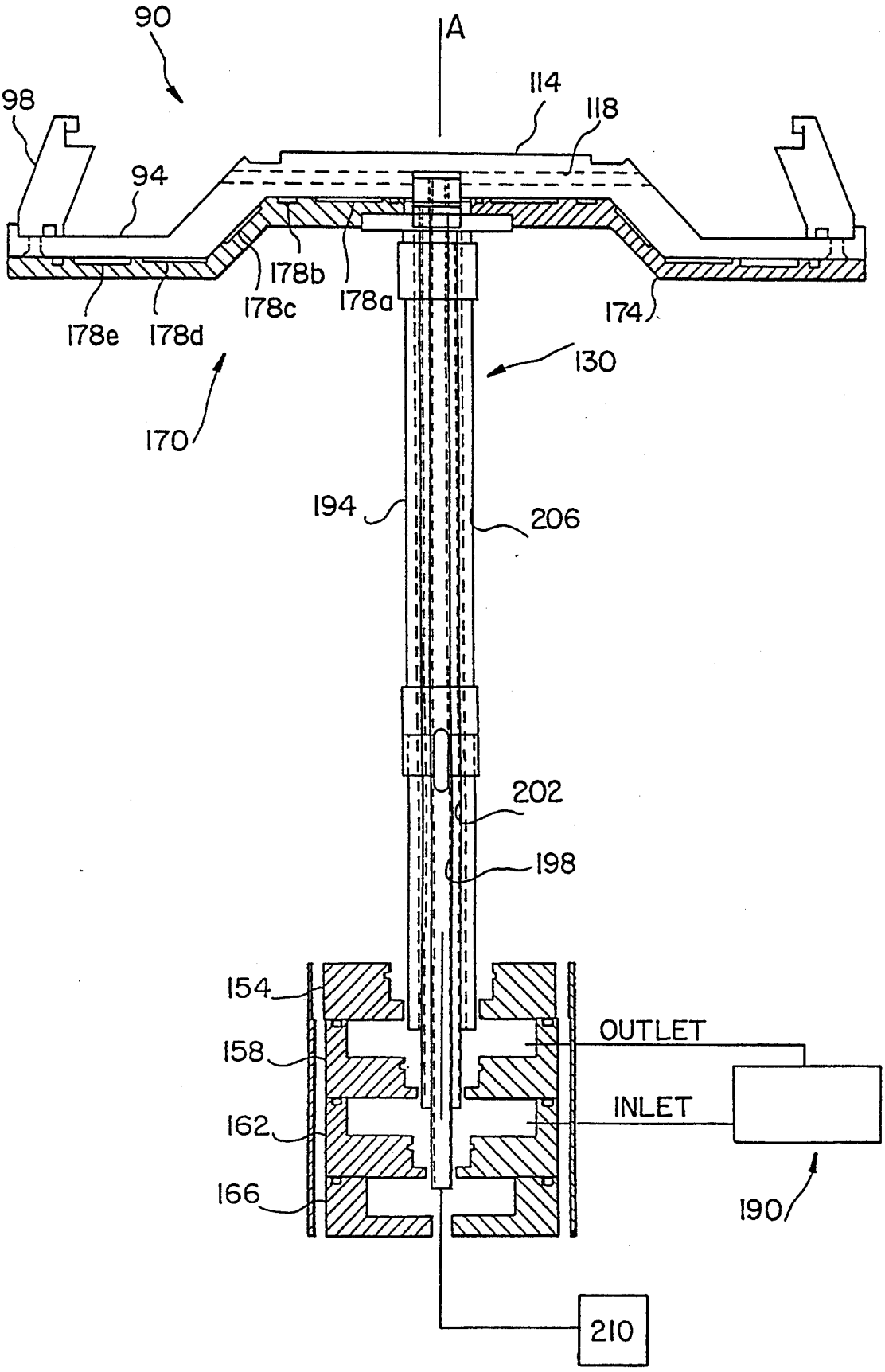
FIG. 5 is a partial longitudinal cross-sectional view of the temperature controlled centrifuge of FIG. 2.

The temperature control assembly 170 interacts with the base 94 of the centrifuge bowl 90 to substantially maintain and/or control the temperature across the base 94, and thus substantially the entire spectrum of materials within the centrifuge bowl 90 interacting therewith. In one embodiment, the temperature control assembly 170 includes a heat exchange plate 174, a portion of the shaft assembly 194, and a temperature-controlling recirculator assembly 190 as illustrated in FIGS. 3–5. Generally, the heat exchange plate 174 is attached to the base 94 and thus rotates with the centrifuge bowl 90 during centrifuging. The heat exchange plate 174 receives an appropriate heat transfer medium from the temperature-controlling recirculator assembly 190 via a portion of the shaft assembly 194 to remove or add heat from the base 94 and thus the spectrum of materials interacting, directly or indirectly, therewith. The heat transfer medium within the heat exchange plate 174 may then be recirculated via the shaft assembly 194 to the temperature-controlling recirculator assembly 190 for cooling or heating and subsequent use in the heat exchange plate 174. As can be appreciated, the temperature of any fluid from the volume variation assembly in the lower chamber of the bowl 90 will also have a tendency to move towards the ambient temperature during centrifuging, if different initially. Therefore, it may be desirable to incorporate an appropriate cooler/heater 210 to control the temperature of this fluid.

The heat exchange plate 174 is appropriately attached to the bottom, exterior portion of the base 94 as best illustrated in FIG. 5. In one embodiment the heat exchange plate 174 substantially approximates the contour of the base 94 and has a surface which is substantially coextensive therewith. Consequently, heat is effectively transferred by conduction through the base 94 and to the surface of the heat exchange plate 174 coextensive therewith. The heat is then removed/added from/to the heat exchange plate 174 by convective heat transfer, namely by the circulation of heat transfer medium through the heat exchange plate 174 as will be discussed in more detail below. Although a variety of factors may of course impact the materials selected for the base 94 and the heat exchange plate 174, one such factor is thermal conductivity. Consequently, in one embodiment the base 94 and the heat exchange plate 174 are aluminum based upon its relatively high thermal conductivity coefficient.

The heat exchange plate 174 may comprise only a single cavity which interfaces with the entire base 94. However, depending upon the respective position of the inlet and the outlet of the heat transfer medium on the heat exchange plate 174, this could result in a lack of circulation of the heat transfer medium along the entire surface of the base 94, a preferential path being created between such inlet and outlet and stagnation areas being formed for the heat transfer medium. Moreover, under certain circumstances the heat transfer requirements may vary across the base 94 depending upon, for instance, the mass of the base 94 in a given region and/or the material within the centrifuge bowl 90 in a particular region. Consequently, in order to provide for an effective distribution of the heat transfer medium throughout the heat exchange plate 174, one embodiment of the present invention includes a plurality of radially separated, discrete, and substantially annular channels **178*a–e* within the heat exchange plate 174, which are thus positioned radially across the base 94 as illustrated in FIGS. 3–5**.

The channels **178*a–e* may be substantially concentrically positioned about the central axis of the heat exchange plate 174, coinciding with rotational axis A of the bowl 90, and the channels 178*a–e* may extend about a substantial circumferential portion of the heat exchange plate 174 (i.e., being substantially annular). These channels 178*a–e* each receive a quantity of heat transfer medium from the temperature-controlling recirculator assembly 190 such that the heat transfer medium may be circulated through each such channel 178*a–e* during rotation of the centrifuge. The heat exchange plate 174 thus allows heat to be removed/added from/to the base 94 at different radial positions from the rotational axis A. In order to enhance the overall heat transfer from the base 94 to the heat exchange plate 174, the upper surface of the channels 178*a–e* is defined by the bottom portion of the base 94, which allows for the direct application of a heat transfer medium to the base 94. However, it can be appreciated that the upper surface of the channels 178*a–e* may alternatively be incorporated into the heat exchange plate 174 itself to provide a closed system (i.e., no direct contact of the heat transfer medium with the base 94**).

Although five channels **178*a–e* are illustrated in the embodiment of the heat exchange plate 174 of FIGS. 3–5, the present invention contemplates using one or more channels for the rotating heat exchanger for accommodating recirculation of the heat transfer medium and preferably more than two. The actual number of channels will depend upon a variety of factors, such as the size of a particular centrifuge bowl 90 and/or the heat transfer requirements in a certain area. Moreover, although substantially annular channels 178*a–e* and their concentric positioning about the rotational axis A of the bowl 90 provides a rotational balance for the centrifuge, other configurations/orientations for the channels 178***a–e* may under certain circumstances be appropriate.

The actual volumetric capacity of the channels 178*a–e* will depend upon a number of factors. Such factors may include the heat transfer requirements considering for instance the mass of the base 94 coinciding therewith and the amount of materials within the centrifuge bowl 90 at a particular radial position, as well as of course the configuration of the heat exchange plate 174 which is again preferably adapted to the contour of the base 94. However, in one embodiment, channel 178*a* has a width of 0.875 inch and a depth of 0.030 inch, channel 178*b* has a width of 0.250 inch and a depth of 0.050 inch, channel 178*c* has a width of 0.625 inch and a depth of 0.050 inch, channel 178*d* has a width of 0.875 inch and a depth of 0.060 inch, and channel 178*e* has a width of 0.750 inch and a depth of 0.080 inch. As used herein, the term "width" refers to a distance across the channels 178*a–e* measured along a radius extending from the center of the heat exchange plate 174.

As noted above, the utilization of a plurality of channels 178*a–e* allows at least in part for an effective distribution of the heat transfer medium throughout the heat exchange plate 174. In order to further enhance this distribution of the heat transfer medium, the heat transfer medium is supplied by the temperature-controlling recirculator assembly 190 to the heat exchange plate 174, via a portion of the shaft assembly 194, through a common inlet 182 in the heat exchange plate 174 which provides the heat transfer medium to each of the channels 178*a–e*. The heat transfer medium is thus also removed from the channels 178*a–e* from a common outlet 186 on the heat exchange plate 174. The inlet and outlet 182, 186 each extend radially outward from the central axis of the heat exchange plate 174 for interconnection with appropriate portions of the shaft assembly 194, which again engages the central portion of the heat exchange plate 174. Consequently, heat transfer medium flows through the inlet 182 away from the central axis of the heat exchange plate 174, while heat transfer medium in the outlet 186 flows back toward the central axis. Although the sizing of the inlet and outlet 182, 186 may vary, in the above-described embodiment in which the channels 178*a–e* have the specified dimensions, the inlet 182 and outlet 186 each have a width of 0.250 inch and a depth of 0.080 inch.

The geometry and the rotation of the centrifuge bowl 90 introduces certain requirements for providing the necessary volume of heat transfer medium through each of the channels 178*a–e*. It may be necessary to make accommodations to ensure that the required flow rate of heat transfer medium is provided to each channel 178*a–e* (i.e., baffling may be required). This may be done by varying the cross-sectional area of the channels 178*a–e* and/or by varying the area at their respective inlets. In the embodiment where the channels 178*a–e* have the above-described dimensions, channel 178*a* thus incorporates a first orifice 180*a* having a width of 0.060 inch, and channels 178*c*, 178*d* incorporate orifices 180*c*, 180*d*, respectively, each having a width of 0.094 inch. This also desirably allows for regulation of the flow rate through the channels 178*a–e*, and thereby provides for a further regulation of the distribution of the heat transfer medium throughout the heat exchange plate 174.

The heat transfer medium is provided to the heat exchange plate 174 by a portion of the shaft assembly 194 as illustrated in FIG. 5. In order to minimize the structural changes required to adapt the temperature control assembly 170 to the centrifuge of the above-described type, the shaft assembly 194 incorporates features to allow the heat transfer medium to be provided to and removed from the heat exchange plate 174, as well as to allow fluid to be provided to and removed from the lower chamber of the centrifuge bowl 90 to vary the volume of the upper chamber by raising and lowering the diaphragm 102 in the above-described manner. The shaft assembly 194 thus generally includes inner, intermediate, and outer conduits 198, 202, 206 such that there are three separate passageways available for receiving a given flow. In one embodiment, hydraulic fluid is provided to the lower chamber of the centrifuge bowl 90 through the inner conduit 198. Moreover, the heat transfer medium is provided to the heat exchange plate 174 in the passageway formed between the inner and intermediate conduits 198, 202, which thereby appropriately interconnects with the inlet 182. Furthermore, the heat transfer medium is removed from the heat exchange plate 174 from the outlet 186 between the intermediate and outer conduits 202, 206, which is thereby appropriately interconnected with the outlet 186. This configuration is desirable in that the pressure of the heat transfer medium being provided to the heat exchange plate 174, which in one embodiment is maintained at approximately 45 psi, is positioned closer to the rotational axis A of the centrifuge bowl 90 than the heat transfer medium exiting the heat exchange plate 174, which in one embodiment is at approximately 2 psi. This assists in increasing the life of the rotating seals (not shown in FIG. 5) in the seal assembly 150. Moreover, the coaxial nature of the shaft assembly 194 in general also facilitates the use of the common inlet and outlet 182, 186 for the channels 178*a–e*, which again allows for the use of flow regulators to further enhance distribution of the heat transfer medium throughout the heat exchange plate 174.

The temperature-controlling recirculator assembly 190 provides the heat transfer medium to and receives the heat transfer medium from the heat exchange plate 174 via the shaft assembly 194 and seal assembly 150 as illustrated in FIG. 5. The temperature-controlling recirculator assembly 190 may thus include appropriate pumps (not shown) and a heat exchanger configuration (not shown) for removing/adding heat from/to the heat transfer medium after passing through the heat exchange plate 174. Although a number of heat transfer mediums may be appropriate (e.g., mediums having a high convective heat transfer coefficient), in one embodiment the heat transfer medium is a 50/50 mixture of ethylene glycol and water. Advantageously, this mixture may also be used by the volume variation assembly such that any mixture of fluids from the temperature control assembly 170 and the volume variation assembly will not adversely affect performance of either assembly. As previously noted, the static seal assembly 150 provides for the appropriate fluid paths to and from the temperature controlling recirculator assembly 190 and the volume variation assembly to the rotating shaft assembly 194. In this regard, the seal assembly 150 may include first, second, third, and fourth seal housings 154, 158, 162, 166 as illustrated in FIGS. 2 and 5. The heat transfer medium may thus be provided to the shaft assembly 194 in the area between the second and third seal housings 158, 162 and the heat transfer medium may be removed from the shaft assembly 194 between the first and second housings 154, 158.

Although the temperature controlled centrifuge of the present invention has been described with regard to a variable volume configuration, those skilled in the art will appreciate that the temperature control assembly 170 may be incorporated on a variety of types of centrifuges and/or other rotating apparatus. Consequently, the present invention encompasses the positioning of a heat exchanger on a rotating apparatus in which it is or could be desirable to maintain and/or regulate the temperature across the base portion of the rotating apparatus.

The foregoing description of the invention has been presented for purposes of illustration and description. Further, the description is not intended to limit the invention to the form disclosed herein. Consequently, variations and modifications commensurate with the above teachings, and the skill and knowledge of the relevant art, are within the scope of the present invention. The embodiments described hereinabove are further intended to explain best modes known of practicing the invention and to enable others skilled in the art to utilize the invention in such, or other, embodiments and with the various modifications required by the particular applications or uses of the invention. It is intended that the appended claims be construed to include alternative embodiments to the extent permitted by the prior art.

What is claimed is:

1. A centrifuge, comprising:

containment means for receiving a material, said containment means comprising a centrifuge bowl and having at least a base portion extending outwardly from a rotational axis of said containment means;

a substantially flexible membrane separating said containment means into upper and lower chambers, the material being positionable within said upper chamber;

drive means for rotating said containment means substantially about said rotational axis of said containment means;

heat exchanger means for controlling a temperature across said base portion of said containment means, said heat exchanger means being interconnected with said base portion and rotatable therewith and isolated from the material within said containment means;

means for varying a volume of said upper chamber by providing a volume variation fluid to said lower chamber to remove at least part of the material from said upper chamber of said containment means during rotation of said containment means by said drive means; and means for controlling a temperature of said volume variation fluid, said means for controlling being separate from said heat exchanger means.

2. A centrifuge, as claimed in claim 1, further comprising:

means for circulating a heat transfer medium through said heat exchanger means.

3. A centrifuge, as claimed in claim 2, wherein:

said heat transfer medium directly contacts said base portion.

4. A centrifuge, as claimed in claim 1, wherein:

said heat exchanger means comprises at least first and second channel means for receiving a heat transfer medium.

5. A centrifuge, as claimed in claim 4, wherein:

said first and second channel means are substantially annular and concentrically positioned about said longitudinal axis, said first and second channel means being positioned at different distances from said axis.

6. A centrifuge, as claimed in claim 4, wherein:

said heat exchanger means comprises inlet and outlet means, said inlet means being fluidly connected to each of said first and second channel means to provide said heat transfer medium thereto, said outlet means being fluidly connected to each of said first and second channel means to receive said heat transfer medium therefrom.

7. A centrifuge, as claimed in claim 6, wherein:

at least said first channel means has an orifice means for controlling the flow of said heat transfer medium into said first channel means.

8. A centrifuge, as claimed in claim 4, wherein:

a volumetric capacity of said first and second channel means is defined in part by the configuration of portions of said base portion overlying said first and second channel means.

9. A centrifuge, as claimed in claim 1, further comprising:

first and second conduit means for providing a heat transfer medium to and removing said heat transfer medium from, respectively, said heat exchanger means.

10. A centrifuge, as claimed in claim 9, wherein:

said first and second conduit means are coaxial.

11. A centrifuge, as claimed in claim 9, wherein:

said first and second conduit means are substantially concentrically positioned about said rotational axis of said containment means.

12. A centrifuge, as claimed in claim 9, wherein: said first conduit means is positioned interiorly of said second conduit means, said heat transfer medium from said heat exchanger means flowing between said first and second conduit means.

13. A centrifuge, as claimed in claim 9, wherein said means for varying comprises:

a volume variation assembly comprising a fluid reservoir, a fluid transfer device, and fluid conduit interconnected with said base portion of said containment means substantially about said rotational axis of said containment means, said first and second conduit means each being concentrically positioned about both said rotational axis and said fluid conduit.

14. A centrifuge, as claimed in claim 1, wherein: a surface of said heat exchanger means substantially approximates a contour of said base portion.

15. A centrifuge, comprising:

containment means for receiving a material, said containment means comprising a centrifuge bowl including a base portion and a wall portion and having a rotational axis;

a substantially flexible membrane separating said containment means into upper and lower chambers, the material being positionable in said upper chamber;

at least one outlet conduit fluidly connectable with an interior portion of said upper chamber of said containment means and extending externally of said centrifuge;

a volume variation assembly interconnected with said lower chamber of said containment means, said volume variation assembly comprising a reservoir of a volume variation fluid, a fluid transfer device, and a volume variation fluid conduit having at least a portion which is substantially concentric with said rotational axis;

heat exchanger means connected to said base portion for maintaining a temperature of said base portion by circulating a heat transfer medium through said heat exchanger means, said heat exchanger means comprising first and second channel means, said first and second channel means being substantially annular and concentrically positioned about said rotational axis at different distances from said rotational axis;

a heat transfer medium supply assembly comprising a heat transfer medium temperature control device;

first conduit means for providing said heat transfer medium from said heat transfer medium supply assembly to said heat exchanger means, at least part of said first conduit means being substantially concentrically positioned about said rotational axis and said at least a portion of said volume variation fluid conduit;

second conduit means for receiving said heat transfer medium from said heat exchanger means and providing said heat transfer medium back to said heat transfer medium supply assembly, at least part of said second conduit means being substantially concentrically positioned about said rotational axis and said at least a portion of said volume variation fluid conduit, whereby said parts of each of said first and second conduit means and said portion of said volume variation fluid conduit are substantially coaxial; and drive means for rotating said containment means substantially about said rotational axis of said containment means.

16. A centrifuge, as claimed in claim 15, wherein: said first conduit means is positioned interiorly of said second conduit means.

17. A centrifuge, as claimed in claim 16, wherein:

a pressure in said first conduit means is greater than a pressure in said second conduit means.

18. A centrifuge, as claimed in claim 15, wherein:

said heat transfer medium directly contacts at least a part of said base portion.

19. A centrifuge, as claimed in claim 15, further comprising: means for controlling a temperature of said volume variation fluid, said means for controlling being separate from said heat exchanger means.

* * * * *